US008187896B1

(12) United States Patent
Poisson

(10) Patent No.: US 8,187,896 B1
(45) Date of Patent: May 29, 2012

(54) ONLINE GAMING SYSTEM FOR SIMULATING A BASEBALL GAME

(76) Inventor: Renald Poisson, Houston, TX (US)

( * ) Notice: Subject to any disclaimer, the term of this patent is extended or adjusted under 35 U.S.C. 154(b) by 406 days.

(21) Appl. No.: 12/427,055

(22) Filed: Apr. 21, 2009

Related U.S. Application Data

(60) Provisional application No. 61/046,853, filed on Apr. 22, 2008.

(51) Int. Cl.
*A63F 9/24* (2006.01)

(52) U.S. Cl. ..... 438/4

(58) Field of Classification Search ..... 463/4, 43; 438/3
See application file for complete search history.

(56) References Cited

U.S. PATENT DOCUMENTS 5,762,337 A * 6/1998 Poisson ..... 273/244.2
5,772,512 A 6/1998 Chichester
5,779,549 A 7/1998 Walker et al.
5,906,370 A 5/1999 Poisson
6,135,885 A 10/2000 Lermusiaux
6,626,434 B2 * 9/2003 Tanaka ..... 273/292
6,758,754 B1 7/2004 Lavanchy et al.
7,361,084 B2 * 4/2008 Takahashi et al. ..... 463/3
2006/0252530 A1 11/2006 Oberberger et al.

* cited by examiner

*Primary Examiner* — Brook Kebede
(74) *Attorney, Agent, or Firm* — Buskop Law Group, PC; Wendy Buskop

(57) ABSTRACT

An online gaming system for simulating a baseball game comprising: a server with a processor, a network in communication with the server, at least one client device in communication with the network, wherein the at least one client device has an input device, a display device, and a monetary acceptance feature, and a database in communication with the processor. The database comprises electronic decks of baseball offense, defense, and playing cards, and computer instructions for randomizing the decks, permitting input of a bet from the input device and monetary acceptance feature, dealing cards, permitting selection and display of cards, determining a game outcome based on the cards selected, and awarding winnings based on the bet and the game outcome.

15 Claims, 9 Drawing Sheets

FIG. 3A

| | | |
|---|---|---|
| GROUND BALL HIT<br>SINGLE<br>RUNNER(S) ADVANCE(S) 1 BASE<br>(CAN ONLY BE BE PLAYED)<br>(ON SINKER OR SLIDER)<br>104 | GROUND BALL HIT<br>INFIELD HIT<br>BATTER SAFE AT 1ST<br>RUNNER HELD AT 2ND<br>(CAN ONLY BE BE PLAYED)<br>(ON CHANGE-UP OR SCREW BALL)<br>(CAN ONLY HAVE MAN ON 2ND)<br>106 | GROUND BALL HIT<br>INFIELD HIT<br>BATTER SAFE AT 1ST<br>RUNNER HELD AT 3RD<br>(CAN ONLY BE BE PLAYED)<br>(ON CHANGE-UP OR SCREW BALL)<br>(CAN ONLY HAVE MAN ON 3RD)<br>108 |
| GROUND BALL HIT<br>110<br>DRAG BUNT<br>BATTER SAFE AT 1ST<br>RUNNER(S) ADVANCE(S) 1 BASE<br>(CAN ONLY BE BE PLAYED)<br>(ON CHANGE-UP OR SCREW BALL) | GROUND BALL HIT<br>112<br>BASE HIT<br>RUNNER(S) ADVANCE(S) 1 BASE<br>(CAN ONLY BE PLAYED)<br>(ON SINKER, SLIDER,)<br>(CHANGE-UP OR SCREW BALL) | GROUND BALL HIT<br>114<br>BASE HIT<br>BATTER GOES TO 1ST<br>LEAD RUNNER(S) ADVANCE(S) 2 BASES<br>(CAN ONLY BE PLAYED)<br>(ON SINKER, SLIDER,)<br>(CHANGE-UP OR SCREW BALL) |
| GROUND BALL HIT<br>DOUBLE<br>RUNNER(S) ADVANCE(S) 2 BASES<br>(CAN ONLY BE BE PLAYED)<br>(ON SINKER, SLIDER,)<br>(CHANGE-UP OR SCREW BALL)<br>116 | GROUND BALL HIT<br>DOUBLE<br>RUNNER ADVANCES 3 BASES<br>(WHEN ONLY RUNNER IS ON 1ST)<br>(CAN ONLY BE PLAYED)<br>(ON SINKER, SLIDER,)<br>(CHANGE-UP OR SCREW BALL)<br>118 | LONG FLY HIT<br>BASE HIT<br>"TEXAS LEAGUER"<br>RUNNER(S) ADVANCE(S) 1 BASE<br>(CAN ONLY BE BE PLAYED)<br>(ON CURVE BALL)<br>120 |

FIG. 5A

| | | |
|---|---|---|
| STEAL<br>RUNNER<br>STEALS ANY BASE<br>(CAN ONLY BE BE PLAYED)<br>(ON CURVE BALL)<br>(THE PITCH IS A BALL IF SAFE)<br>(CAN ONLY HAVE ONE MAN ON BASE)<br>(CAN ONLY STEAL HOME WITH 2 OUTS)<br>X<br>150 | STEAL<br>RUNNER ON 1ST<br>STEALS 2ND BASE<br>(CAN ONLY BE BE PLAYED)<br>(ON CHANGE-UP)<br>(THE PITCH IS A STRIKE IF SAFE)<br>(CAN ONLY HAVE ONE MAN ON BASE)<br>X<br>152 | STEAL<br>RUNNER ON 2ND<br>STEALS 3RD BASE<br>(CAN ONLY BE BE PLAYED)<br>(ON SCREW BALL)<br>(THE PITCH IS A STRIKE IF SAFE)<br>(CAN ONLY HAVE ONE MAN ON BASE)<br>X<br>154 |
| DOUBLE STEAL OUT<br>LEAD RUNNER OUT<br>ON DOUBLE STEAL<br>X<br>156 | OUT STEALING<br>RUNNER OUT<br>STEALING ANY BASE<br>X<br>158 | OUT STEALING<br>RUNNER OUT<br>STEALING 2ND BASE<br>X<br>160 |
| OUT STEALING<br>RUNNER OUT<br>STEALING 3RD BASE<br>X<br>162 | DOUBLE STEAL<br>RUNNERS<br>STEAL ANY 2 BASES<br>X<br>164 | SACRIFICE HIT<br>RUNNER(S) ADVANCE(S)<br>BATTER OUT AT 1ST BASE<br>(CAN NOT BE BE PLAYED)<br>(ON FAST BALL OR CURVE BALL)<br>X<br>166 |

FIG. 5B

| | | |
|---|---|---|
| SACRIFICE BUNT | RUNNER(S) ADVANCE(S)<br>BATTER OUT AT 1ST BASE<br>(CAN NOT BE BE PLAYED)<br>(ON FAST BALL OR CURVE BALL)<br>X | 168 |
| HIT BATSMAN | BATTER ADVANCES TO 1ST BASE<br>(CAN BE PLAYED ON ANY PITCH)<br>X | 170 |
| WILD PITCH | RUNNER(S) ADVANCE(S) ONE BASE<br>(CAN NOT BE BE PLAYED)<br>(ON FAST BALL OR CHANGE-UP)<br>(THE PITCH IS A BALL)<br>X | 172 |
| PASS BALL | RUNNER(S) ADVANCE(S) ONE BASE<br>(CAN NOT BE PLAYED)<br>(ON CURVE BALL OR CHANGE-UP)<br>(THE PITCH IS A STRIKE)<br>X | 174 |
| DOUBLE PLAY | RUNNERS ARE OUT AT 1ST AND 2ND BASE<br>(CAN ONLY BE BE PLAYED)<br>(ON GROUND BALL HIT)<br>X | 176 |
| DOUBLE PLAY | BATTER IS OUT AND MAN ON 1ST IS DOUBLED UP<br>(CAN ONLY BE BE PLAYED)<br>(ON LINE DRIVE HIT)<br>X | 178 |
| INFIELD ERROR | BATTER SAFE AT 1ST RUNNER(S) ADVANCE(S) ONE BASE<br>(CAN NOT BE PLAYED)<br>(ON FAST BALL OR CURVE BALL)<br>X | 180 |
| 2 BASE ERROR | BATTER GOES TO 2ND RUNNER(S) ADVANCE(S) TWO BASES<br>(CAN ONLY BE PLAYED)<br>(ON FAST BALL OR CURVE BALL)<br>X | 182 |
| OUTFIELD ERROR | BATTER SAFE AT 1ST RUNNER(S) ADVANCE(S) ONE BASE<br>(CAN ONLY BE PLAYED)<br>(ON CURVE BALL OR CHANGE-UP)<br>X | 184 |

ONLINE GAMING SYSTEM FOR SIMULATING A BASEBALL GAME

CROSS REFERENCE TO RELATED APPLICATIONS

This application claims priority to U.S. Provisional Application Ser. No. 61/046,853 filed on Apr. 22, 2008, entitled: "Online Gaming System for Simulating a Baseball Game". This reference is hereby incorporated in its entirety herein.

FIELD

The present embodiments generally relate to an online gaming system for simulating a baseball game. The simulated baseball game closely follows how major league baseball games are played and includes a monetary acceptance feature for placing bets based on game outcome.

BACKGROUND

A need exists for an online gaming system that simulates a game of baseball that closely follows the manner in which major league baseball games are played, while enabling users to experience the simulated baseball game from a home computer, a public computer, or a gaming machine.

A further need exists for an online gaming system that simulates a game of baseball by using cards, thereby incorporating card game elements, such as bluffing, learning playing strategies of opponents, reading opponents to determine bluffs, counting cards, and the confrontation and competitive aspects of popular card games.

A need also exists for an online gaming system for providing a simulated game of baseball that allows users to place bets and receive winnings based on odds and game outcomes, in the style of popular slot and video card machines.

The present embodiments meet these needs.

BRIEF DESCRIPTION OF THE DRAWINGS

The detailed description will be better understood in conjunction with the accompanying drawings as follows:

FIG. 3A and FIG. 3B depict an embodiment of baseball offense cards.

FIG. 5A, FIG. 5B, FIG. 5C, and FIG. 5D depict an embodiment of baseball situation cards.

Figure 1:
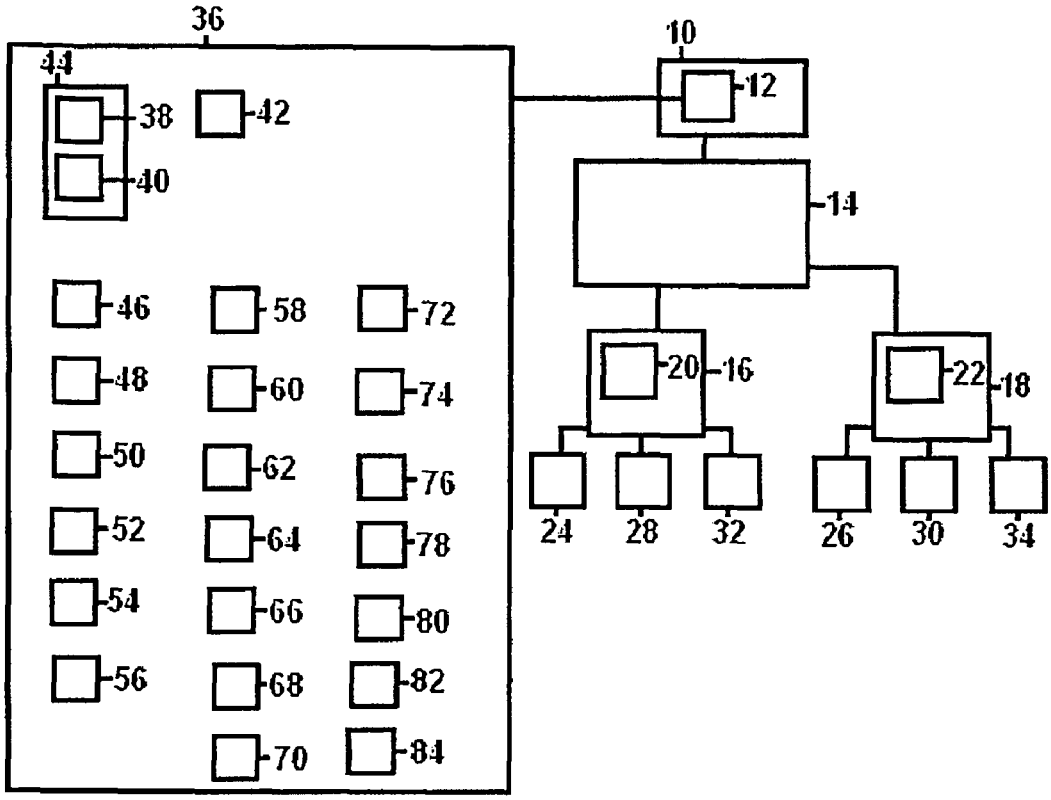
FIG. 1 depicts a schematic drawing of the components of an embodiment of the present system.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an online gaming system for simulating a baseball game that combines game-play and finesse elements found in popular card games with odds and gambling elements found in slot and video card games.

The present system provides the benefit of enabling one or more users to participate in a simulated baseball game that closely follows the manner in which major league baseball games are played. Cards representing various types of pitches used in a game of baseball can be played, and cards representing various types of hits, offensive plays, and offensive situations, can be played responsive to the pitches to represent the actions of a simulated hitting baseball team. Cards representing defensive plays and defensive situations can be played responsive to the hit, offensive play, and offensive situation cards, representing the actions of a simulated fielding baseball team. The outcome of each play is determined based on the instructions provided on each card played.

Through use of a database, which can be in communication with a network-accessible server, the present system can be accessed directly or remotely by any number of users, individually or simultaneously, for supporting both competitive play between human opponents and play against a simulated player controlled by the server processor.

The present system can enable users to enjoy a simulated game of baseball that incorporates both card game and gambling elements, from the comfort of a home computer, or using publicly accessible machines in arcades, casinos, and other similar locations.

The present system is advantageously easy to utilize and can permit use of any type and any number of input devices, including a keyboard, a mouse, a touch screen, or other similar input devices. Through use of computer instructions, the present system can automatically randomize and deal cards, and a user need only select visible cards depicted on a display device to cause the simulated baseball game to progress. The present system can automatically deal replacement cards, as necessary, and perform all necessary processes and calculations to determine a game outcome based on the selected cards.

The present system can provide education relating to the sport of baseball to players and onlookers in a fun and entertaining manner, using the strategic and finesse-based elements of card gaming.

The present system can include a server having a processor, which can be an Intel™ processor, an AMD™ processor, or another similar type of processor able to execute computer instructions.

One or more networks can be in communication with the server. Useable networks can include the internet, an intranet, a local area network, a wide area network, a virtual private network, a satellite network, a cellular network, other similar networks, and combinations thereof.

At least one client device can communicate with the processor through at least one user interface, which can be in communication with the network. Each client device can be contemplated to include one or more input devices, display devices, and a monetary acceptance feature.

Client devices can include computers, dumb terminals and/or gaming machines in communication with the network, or other devices able to accept input, display output, and communicate with a network, such as a personal digital assistant, a cellular telephone, and similar devices.

It can be contemplated that useable input devices can include a keyboard, a mouse, a keypad, a touch screen, a microphone or speaker and speech-to-text software, and other similar devices.

Monetary acceptance features can include means for accepting credit cards and debit cards, such as card readers, means for accepting currency, such as bill and coin insertion slots, means for accepting facility-specific credits, such as readers for cards issued by casinos, or combinations thereof. It can also be contemplated that one or more input devices could also function as a monetary acceptance feature. For example, a computer keyboard or a keypad on a cellular telephone can be used to input a credit card or debit card number and other information necessary to process charges. A mouse or touch screen can also be used to select numbers to input credit card or debit card information.

The present system can also include a database in communication with the processor.

The database can include an electronic deck of baseball offense cards and an electronic deck of baseball defense cards.

The baseball offense cards can include baseball offense hit cards, which can each have a type of offensive play indicated thereon, such as ground ball single, ground ball infield hit, ground ball drag bunt, ground ball base hit, ground ball double, long fly base hit, long fly double, long fly triple, long fly home run, line drive base hit, line drive double, line drive triple, and line drive homerun. It can be contemplated that each baseball offense hit card can also include one or more instructions indicating one or more types of pitches for which the baseball offense hit card can be played responsively, and one or more instructions indicating the effect of the card on a game outcome, such as advancement of the simulated batter and/or one or more simulated runners.

The baseball offense cards can also include baseball offense call cards, which can be contemplated to be ball cards.

The baseball defense cards can include baseball defense play cards and baseball defense call cards. The baseball defense play cards can each have a type of defensive play indicated thereon, such as ground ball out, long fly out, and line drive out. The baseball defense ball cards can be contemplated to include foul ball call cards and strike cards. It can be contemplated that each baseball defense card can include one or more instructions indicating hits for which the baseball defense card can be played responsively, and one or more instructions indicating the effect of the card on a game outcome, such as the accumulation of an out and the nullification of any advancement indicated on the baseball offense card that was played.

The database can further include an electronic deck of playing cards, which can be contemplated to include a plurality of pitch cards and a plurality of situational play cards.

Each pitch card can have a type of pitch indicated thereon, such as fast ball, curve ball, sinker, change-up, slider, and screw ball.

Each situational play card can be an offense situational play card having a type of offense situation indicated thereon, such as steal, double steal, hit batsman, wild pitch, past ball, error, hit and run, suicide squeeze, and pinch hit. Each situational play card can also be a defense situational play card having a type of defense situation indicated thereon, such as out stealing, double steal out, double play, intentional walk, and pinch hit out.

Baseball offense cards and offense situational play cards can be contemplated to have instructions for advancing a simulated batter, a simulated runner, or combinations thereof, a number of simulated bases. Baseball offense cards and offense situational play cards can also be contemplated to have instructions listing certain types of pitches that would advance the simulated batter, simulated runner, or combinations thereof.

For example, a "line drive" card which advances a simulated batter and each simulated runner one base can have instructions displayed thereon that indicate this advancement of the simulated batter and/or simulated runners. The line drive card can also include instructions indicating that the card can only be played in response to certain types of pitch cards, such as a fast ball card.

Baseball defense cards and defense situational play cards can be contemplated to have instructions indicating that the simulated batter, simulated runner, or combinations thereof, is out. Baseball defense cards and defense situational play cards can also be contemplated to have instructions listing certain types of offense plays or offense situations that would indicate that the simulated batter, the simulated runner, or combinations thereof, is out.

For example, a "line drive out" card can be played in response to a line drive card, preventing the advancement of the simulated batter and/or simulated runners indicated by the line drive card, and resulting in the accumulation of an out.

The database can include computer instructions for instructing the processor to electronically randomize the electronic deck of baseball offense cards with the electronic deck of baseball defense cards to form a shuffled deck. The randomized order of the shuffled deck can then be stored in the database. It can also be contemplated that the electronic randomization of the shuffled deck can be performed by randomly determining each card dealt from the shuffled deck at the time the card is electronically dealt.

Computer instructions in the database can also instruct the processor permit input of a bet from the input device and the monetary acceptance feature through the user interface and the network to the server. For example, a user can insert a credit card into a credit card reader, then use a keyboard or touch screen to enter and confirm a bet amount.

Bets accepted by the processor can include bets relating to the winner of the game, bets specifying which team will have more points at a certain point in the game, or similar bets relating to the game outcome. Bets can also be placed relating to amounts of points scored by either or both simulated baseball teams, the spread in points between the two simulated teams, or other bets relating to point totals. Bets can also be placed relating to individual plays and/or game outcomes, such as whether the next card played will result in points scored, one or more bases advanced, one or more outs, a double play, a stolen base, a home run, or any other possible game outcome.

Additional computer instructions can instruct the processor to electronically deal a first plurality of cards from the shuffled deck and display the first plurality of cards on the display device. It can be contemplated that the first plurality of cards constitutes the user's hand.

Computer instructions can also instruct the processor to electronically deal a second plurality of cards from the shuffled deck to a simulated player controlled by the processor. In an embodiment, the second plurality of cards can instead be dealt to a second user playing competitively with a first user. It can be contemplated that the first and second pluralities of cards can include equal numbers of cards. Each plurality of cards can include any number of individual cards, such as from five to fifteen cards. In an embodiment, each plurality of cards can include nine cards, representative of the number of players on the lineup of a baseball team.

Computer instructions can then instruct the processor to designate a baseball offense player and a baseball defense player. The designation can be performed randomly. In an embodiment, the computer instructions can permit selection by a user using the input device to indicate whether the user wishes to begin play as the baseball offense player or the baseball defense player.

Additional computer instructions can instruct the processor to electronically deal a third plurality of cards from the electronic deck of playing cards to the baseball offense player and the baseball defense player. The third plurality of cards can be contemplated to include pitch cards and situational play cards to be played responsive to other cards.

Computer instructions can then facilitate game play by instructing the processor to permit selection of a pitch card by the baseball defense player and display the pitch card on the display device. In an embodiment, the pitch card can be randomly dealt from a deck of pitch cards. The pitch card can simulate the type of pitch thrown by the fielding baseball team.

The computer instructions can then instruct the processor to permit selection of a second card by the baseball offense player responsive to the pitch card, and to display the second card on the display. The second card can simulate the action of the batting baseball team in response to the pitch card. For example, the baseball offense player can select a baseball offense hit card that indicates the type of pitch represented by the pitch card to advance the simulated batter and/or simulated runners, a baseball offense call card that causes the pitch to be recorded as a ball, or a baseball offense situation card that indicates the type of pitch represented by the pitch card to attempt an offensive play, such as a stolen base. The baseball offense player can also select a card that does not indicate the type of pitch on the pitch card and discard the card, causing the accumulation of a strike.

The computer instructions can further instruct the processor to electronically deal to the baseball offense player a replacement card for the second card from the shuffled deck.

Computer instructions can instruct the processor to permit selection of a third card by the baseball defense player. The third card can be discarded, or the third card can be played in response to the second card if the third card includes instructions indicating the type of hit or offensive play represented by the second card. If played, the computer instructions can instruct the processor to display the third card on the display. The computer instructions can also instruct the processor to display the third card on the display if the third card is discarded, to facilitate tracking of possible future plays by counting cards.

The computer instructions can further instruct the processor to electronically deal to the baseball defense player a replacement card for the third card from the shuffled deck.

Computer instructions can then instruct the processor to determine a game outcome based on the pitch card, the second card, and the third card, and to award winnings based on the bet and the game outcome.

Game outcomes can include calling a simulated batter and/or one or more simulated runners out, advancing a simulated batter and/or simulated runners one or more bases, calling balls or strikes, scoring points, or combinations thereof. In an embodiment, computer instructions can instruct the processor to play a video, animation, or combinations thereof, that depicts a representation of the game outcome. For example, a video or animation of a batter hitting a sacrifice fly ball to right field while a third base runner reaches home plate can be played when the baseball offense player plays a baseball offense card indicating such a result.

For example, a baseball defense player can select a "fast ball" card. A baseball offense player can select a "line drive" card in response to the fast ball card. The baseball defense player can then select and play a "line drive out" card in response to the line drive card. The present system can then determine the game outcome using each of the three cards. If the baseball offense player did not have a card that could be played responsive to the fast ball card, or if the baseball offense player did not wish to play a card responsive to the fast ball card, the baseball offense player can discard a card, and a strike can be accumulated. If the baseball defense player did not have a card that could be played responsive to the line drive card, or did not wish to play a card responsive to the line drive card, the baseball defense player can discard a card, and the outcome indicated by instructions on the line drive card would occur.

It can be contemplated that the second card, played by the baseball offense player, can be an offense card or offense situational card that lists the type of pitch indicated on the pitch card, for advancing the simulated batter, the simulated runner, or combinations thereof. The second card can simulate a batting team's response to the pitch indicated on the pitch card.

For example, the second card can indicate a type of hit, an attempt to steal a base, or a similar baseball offense action. It can be contemplated that if the second card includes a type of pitch corresponding to the type of pitch indicated on the pitch card, the instructions for advancing a simulated batter and/or simulated runners can be followed. If the second card does not include the type of pitch indicated by the pitch card, it can be contemplated that a strike can be tallied against the baseball offense player.

The third card can be a defense play card or a defense situational card that lists the type of offense play or offense situation indicated on the second card, to indicate that the simulated batter and/or one or more simulated runners are out. The third card can simulate a fielding team's response to a batting team's hit or offensive play.

Each third card can indicate a specified type of hit corresponding to a baseball offense card, or a specified type of situational play corresponding to an offense situational card. If a player does not have a third card that includes a corresponding type of hit or situational play, the third card can instead be discarded for replacement, allowing the baseball defense player to change his or her hand.

The present system can also include computer instructions in the database for instructing the processor to display a simulated baseball field on the display device. The simulated baseball field can be contemplated to include a first base, a second base, a third base, a home plate, an area to record outs, an area to record points, and an area to record a count constituted by strikes and balls.

The computer instructions can also instruct the processor to display a simulated batter, at least one simulated runner, or combinations thereof, on the simulated baseball field.

Additional computer instructions can instruct the processor to update on the display device a position of the simulated batter, a position of one or more simulated runners, a number of outs, a number of strikes, a number of balls, a number of points, or combinations thereof, based on the game outcome.

This embodiment can enable the simulated baseball game to be represented not only using cards and/or tabular means, but through graphical means as well.

In an embodiment, the present system can also include a secondary bonus slot game. Computer instructions in the database can instruct the processor to display the secondary bonus slot game if one or more play achievements occur. Play achievements can include scoring one or more points, achieving one or more outs, balls, or strikes, advancing a predetermined number of bases, hitting a home run, achieving a double play, or any other possible game outcome.

The computer instructions can then instruct the processor to permit input of a bonus bet from the input device and the monetary acceptance feature through the user interface and network to the server.

The computer instructions can instruct the processor to electronically spin reels of the secondary bonus slot game and stop the reels, then award bonus winnings based on the bonus bet and the play achievements.

In an embodiment, the present system can also be used to simulate a baseball game that includes four players and/or simulated players. In this embodiment, computer instructions can permit a first baseball defense player representing the pitcher to select pitch cards, two baseball offense players to select offense and situational cards responsive to the pitch cards, and a second baseball defense player representing the catcher and fielders to select defense and situational cards responsive to the cards selected by the baseball offense players.

In this embodiment, the second defense player can be permitted to select one or more catcher cards, used to simulate signs, to be displayed in order to provoke a certain type of pitch to be played by the first defense player. Catcher cards can include numbers, text, symbols, or combinations thereof, and can be displayed in any selected orientation. Catcher cards can be used in combination with other signs, such as physical, verbal, or textual signs or messages.

Referring now to FIG. 1, a schematic drawing of an embodiment of the present system is depicted.

FIG. 1 depicts a server (10) having a processor (12). The server (10) can be in communication with a network (14). While FIG. 1 depicts the server (10) in communication with a single network (14), it can be contemplated that the server (10) can be in communication with any type and any number of networks simultaneously.

A first client device (16) and a second client device (18), having a first user interface (20) and a second user interface (22) can be in communication with the network (14). The first client device (16) has a first input device (24) and a first display device (28). The second client device (18) has a second input device (26) and a second display device (30).

While each client device is depicted having a single input device and display device, it can be contemplated that each client device can include any type and number of input and display devices.

The first client device (16) can also include a first monetary acceptance feature (32). The second client device (18) can include a second monetary acceptance feature (34).

A database (36) can be in communication with the processor (12). The database (36) can be resident in the server (10) and in direct communication with the processor (12). The database (36) can also be remote from the server (10) and in communication with the processor (14) via the network (14).

The database (36) is shown containing an electronic deck of baseball offense cards (38) and an electronic deck of baseball defense cards (40), which have been combined and electronically randomized to form a shuffled deck (44).

The database (36) is also shown containing an electronic deck of playing cards (42).

Computer instructions (46) in the database (36) can instruct the processor (12) to form the shuffled deck (44) by electronically randomizing the electronic deck of baseball offense cards (38) with the electronic deck of baseball defense cards (40).

Computer instructions (48) in the database (36) can instruct the processor (12) to permit input of a bet using one of the input devices (24, 26) and one of the monetary acceptance features (32, 34). It can be contemplated that the bet can be stored in the database (36) until the game outcome is determined and winnings can be awarded.

Computer instructions (50) in the database (36) can instruct the processor (12) to electronically deal a first plurality of cards from the shuffled deck (44) and to display the first plurality of cards on the display device (28). The first plurality of cards can be contemplated to constitute a user's hand.

Computer instructions (52) in the database (36) can also instruct the processor (12) to electronically deal a second plurality of cards from the shuffled deck (44) to a second player. The second plurality of cards can be contemplated to constitutes the second player's hand. The second player can be a human opponent of the first user, or the second player can be a simulated player controlled by the processor (12). If the second player is a human opponent, the second plurality of cards can be displayed on the display device (30).

Computer instructions (54) in the database (36) can then instruct the processor (12) to designate a baseball offense player and a baseball defense player. The designation of the baseball offense and defense players can be a random designation, or in an embodiment, a user can be permitted to designate the baseball offense and defense players.

Computer instructions (56) in the database (36) can instruct the processor (12) to electronically deal a third plurality of cards from the electronic deck of playing cards (42) to the baseball offense player and the baseball defense player. The third plurality of cards can be contemplated to include pitch cards for play by the baseball defense player, and situational play cards for play by each player in response to other cards.

Computer instructions (58) in the database (36) can instruct the processor (12) to permit selection of a pitch card by the baseball defense player and to display the pitch card on the display device (28, 30). In an embodiment, the pitch card can be randomly dealt from a deck of pitch cards.

Computer instructions (60) in the database (36) can instruct the processor (12) to permit selection of a second card by the baseball offense player responsive to the pitch card and to display the second card on the display device (28, 30). The second card can also be discarded, rather than played responsive to the pitch card. If discarded, it can be contemplated that the second card can still be displayed on the display device (28, 30), to facilitate card counting and tracking of possible future plays.

Computer instructions (62) in the database (36) can then instruct the processor (12) to electronically deal a replacement card for the second card from the shuffled deck (44).

In an embodiment, computer instructions (64) in the database (36) can instruct the processor (12) to permit selection of a third card by the baseball defensive player and to display the third card on the display device (28, 30). The third card can be played responsive to the second card or discarded.

Computer instructions (66) in the database (36) can then instruct the processor (12) to electronically deal a replacement card for the third card from the shuffled deck (44).

Computer instructions (68) in the database (36) can instruct the processor (12) to determine a game outcome based on the pitch card, the second card, and the third card. Computer instructions (70) in the database (36) can also instruct the processor (12) to award winnings based on the bet and the game outcome.

FIG. 1 also depicts computer instructions (72) in the database (36) for instructing the processor (12) to display a simulated baseball field. The baseball field can be contemplated to include bases, a home plate, areas to record outs, points, strikes and balls, and other similar features.

Computer instructions (74) in the database (36) can instruct the processor (12) to display a simulated batter and/or one or more simulated runners on the simulated baseball field.

Computer instructions (76) in the database (36) can also instruct the processor (12) to update positions of simulated batters and/or runners, numbers of strikes, outs, balls, and/or points, or combinations thereof, based on the game outcome.

FIG. 1 further depicts computer instructions (78) in the database (36) for instructing the processor (12) to display a secondary bonus slot game if one or more play achievements occur. For example, the secondary bonus game can be engaged each time a home run is hit, each time a run is scored, each time three outs are achieved, or for any other possible game outcome.

Computer instructions (80) in the database (36) can instruct the processor (12) to permit input of a bonus bet from the input device (24) and the monetary acceptance feature (32) through the user interface (20) and the network (14).

Computer instructions (82) in the database (36) can also instruct the processor (12) to electronically spin and stop reels of the secondary bonus slot game, or otherwise generate a graphical outcome of the secondary bonus slot game.

Computer instructions (84) in the database (36) can then instruct the processor (12) to award bonus winnings based on the bonus bet and one or more play achievements.

Figure 2:
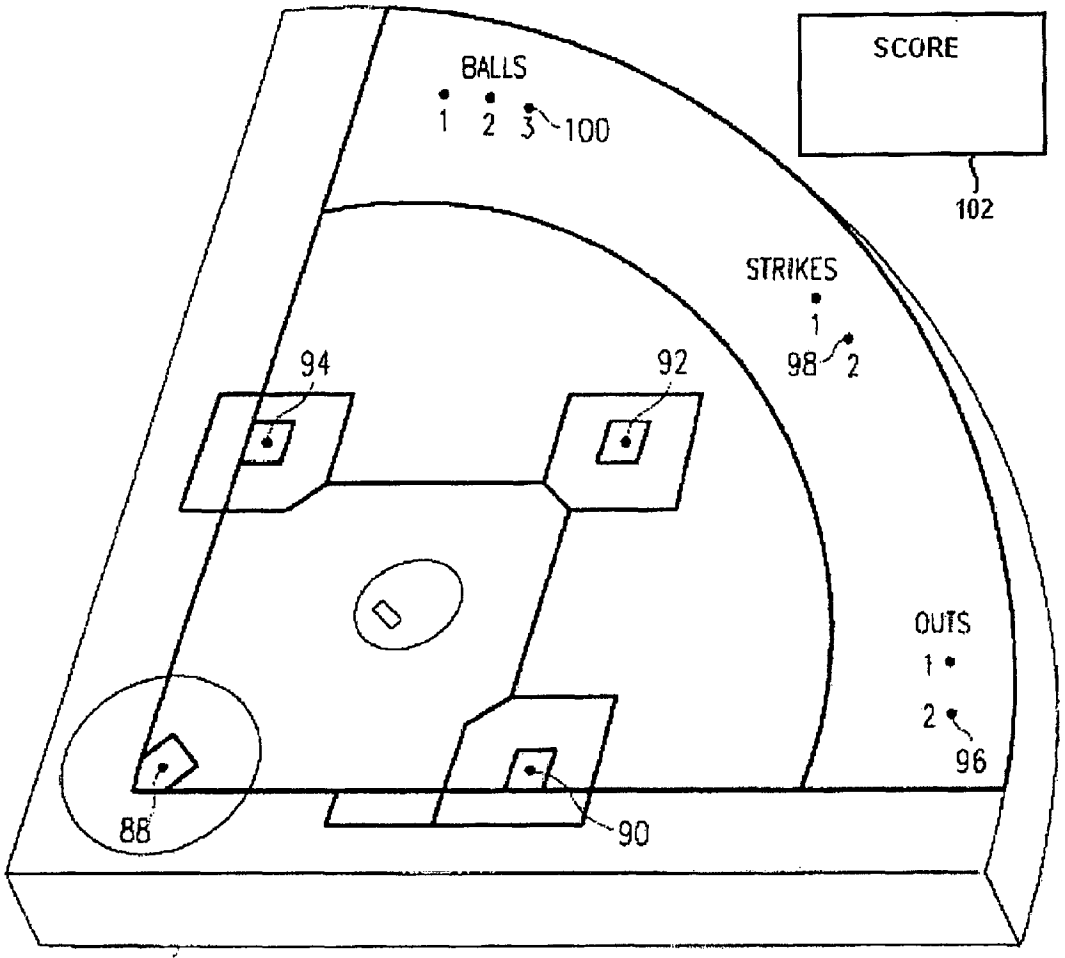
FIG. 2 depicts a display of an embodiment of a simulated baseball field.

FIG. 2 depicts an embodiment of a simulated baseball field (86) which can be displayed on one or more display devices. The simulated baseball field (86) is shown having a home plate (88), a first base (90), a second base (92), and a third base (94).

The simulated baseball field (86) can also include an area for recording outs (96), an area for recording strikes (98), an area for recording balls (100), and an area for recording points (102).

Figure 3B:
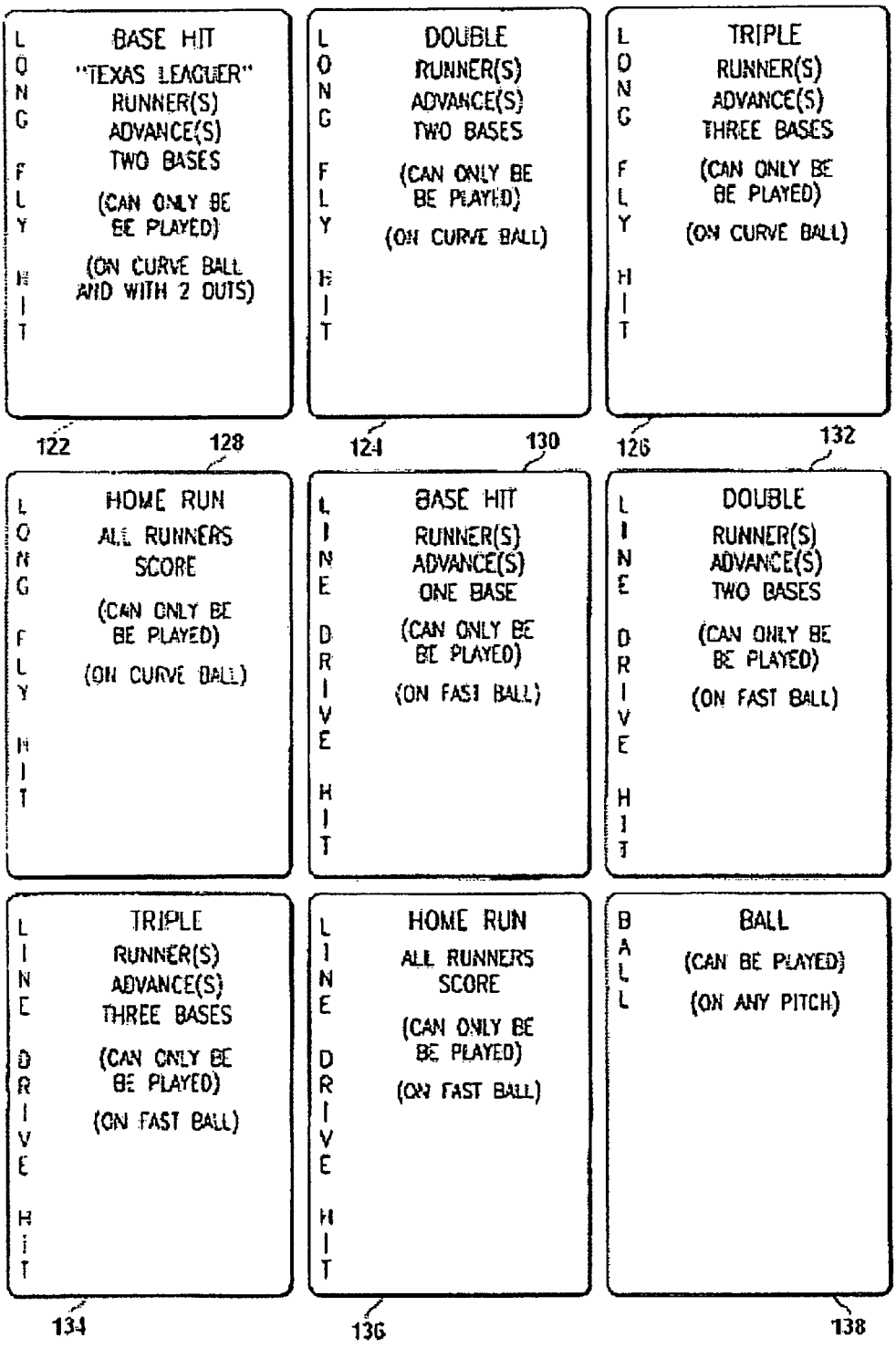

FIG. 3A and FIG. 3B depict embodiments of baseball offense cards, which can include baseball offense hit cards and baseball offense call cards.

FIG. 3A depicts a ground ball single card (104), a first ground ball infield hit card (106), a second ground ball infield hit card (108), a ground ball drag bunt card (110), a first ground ball base hit card (112), a second ground ball base hit card (114), a first ground ball double card (116), a second ground ball double card (118), and a first long fly base hit card (120).

FIG. 3B depicts a second long fly base hit card (122), a long fly double card (124), a long fly triple card (126), a long fly home run card (128), a line drive base hit card (130), a line drive double card (132), a line drive triple card (134), and a line drive home run card (136). FIG. 3B also depicts a baseball offense call card, which is a ball card (138).

Figure 4:
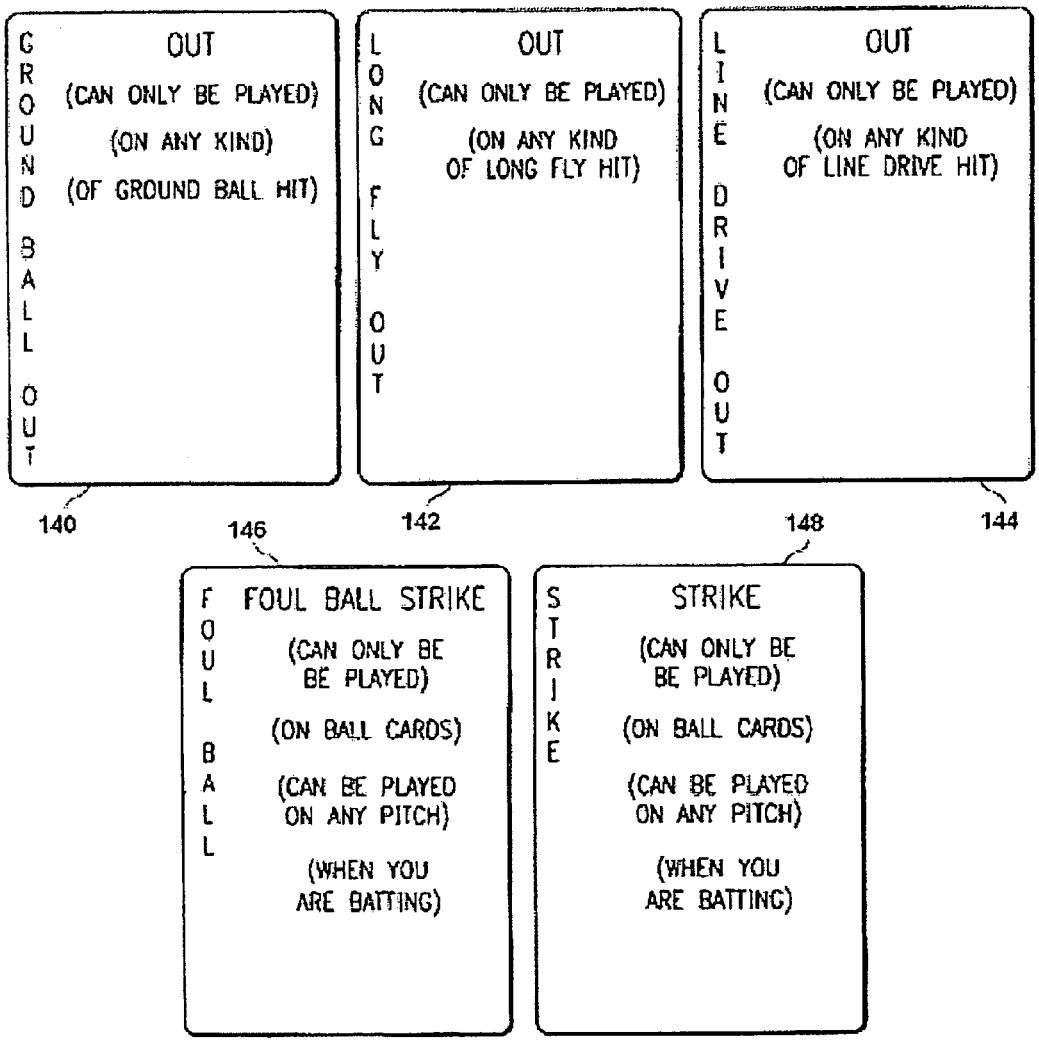
FIG. 4 depicts an embodiment of baseball defense cards.

FIG. 4 depicts embodiments of baseball defense cards, which can include baseball defense play cards and baseball defense call cards.

FIG. 4 depicts a ground ball out card (140), a long fly out card (142), and a line drive out card (144). FIG. 4 also depicts baseball defense call cards, including a foul ball card (146) and a strike card (148).

FIG. 5A depicts embodiments of baseball situational cards, which can be played to simulated stolen bases, catching runners out stealing, sacrifice hits, hit batsmen, wild pitches, past balls, errors, double plays, balks, pinch hits, suicide squeezes, pinch hit outs, intentional walks, hit and runs, and other baseball plays.

FIG. 5A depicts steal cards including a runner steals any base card (150), a runner on 1st steals 2nd base card (152), a runner on 2nd steals 3rd base card (154). FIG. 5A also depicts out stealing cards including a lead runner out on double steal card (156), a runner out stealing any base card (158), a runner out stealing 2nd base card (160), a runner out stealing 3rd base card (162). FIG. 5A further depicts a double steal card, which is a runners steal any 2 bases card (164). FIG. 5A also depicts a sacrifice hit card, which is a runner(s) advance(s) batter out at 1st base card (166).

FIG. 5B depicts a sacrifice bunt card, which is a runner(s) advance(s) batter out at 1st base card (168). FIG. 5B further depicts a hit batsman card, which is a batter advances to 1st base card (170), a wild pitch card, which is a runner(s) advance(s) one base card (172), and a past ball card, which is a runner(s) advance(s) one base card (174). FIG. 5B also depicts double play cards, which include runners are out at 1st and 2nd base card (176) and a batter is out and man on 1st is doubled up card (178).

FIG. 5B also depicts an infield error card, which is a batter safe at 1st runner(s) advance(s) card (180). FIG. 5B depicts a 2 base error card, which is a batter goes to 2nd runner(s) advance(s) two bases card (182). FIG. 5B further depicts an outfield error card, which is a batter safe at 1st runner(s) advance(s) one base card (184).

Figure 5C:
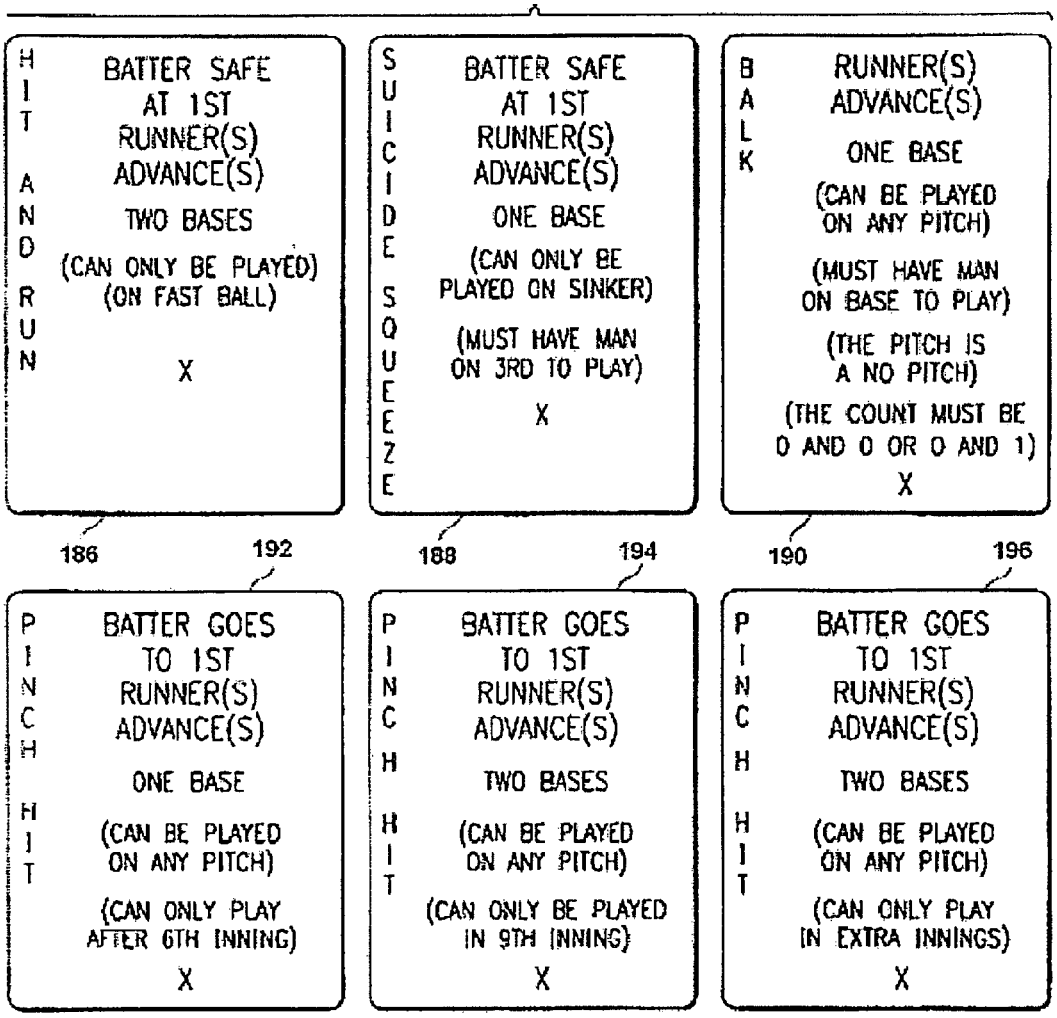

FIG. 5C depicts a hit and run card, which is a batter safe at 1st runner(s) advance(s) two bases card (186). FIG. 5C also depicts a suicide squeeze card, which is a batter safe at 1st runner(s) advance(s) one base card (188). FIG. 5C depicts a balk card, which is a runner(s) advance(s) one base card (190). FIG. 5C further depicts pinch hit cards, which include a batter goes to 1st runner(s) advance(s) one base card (192), a first batter goes to 1st runner(s) advance(s) two bases card (194), and a second batter goes to 1st runner(s) advance(s) two bases card (196).

Figure 5D:
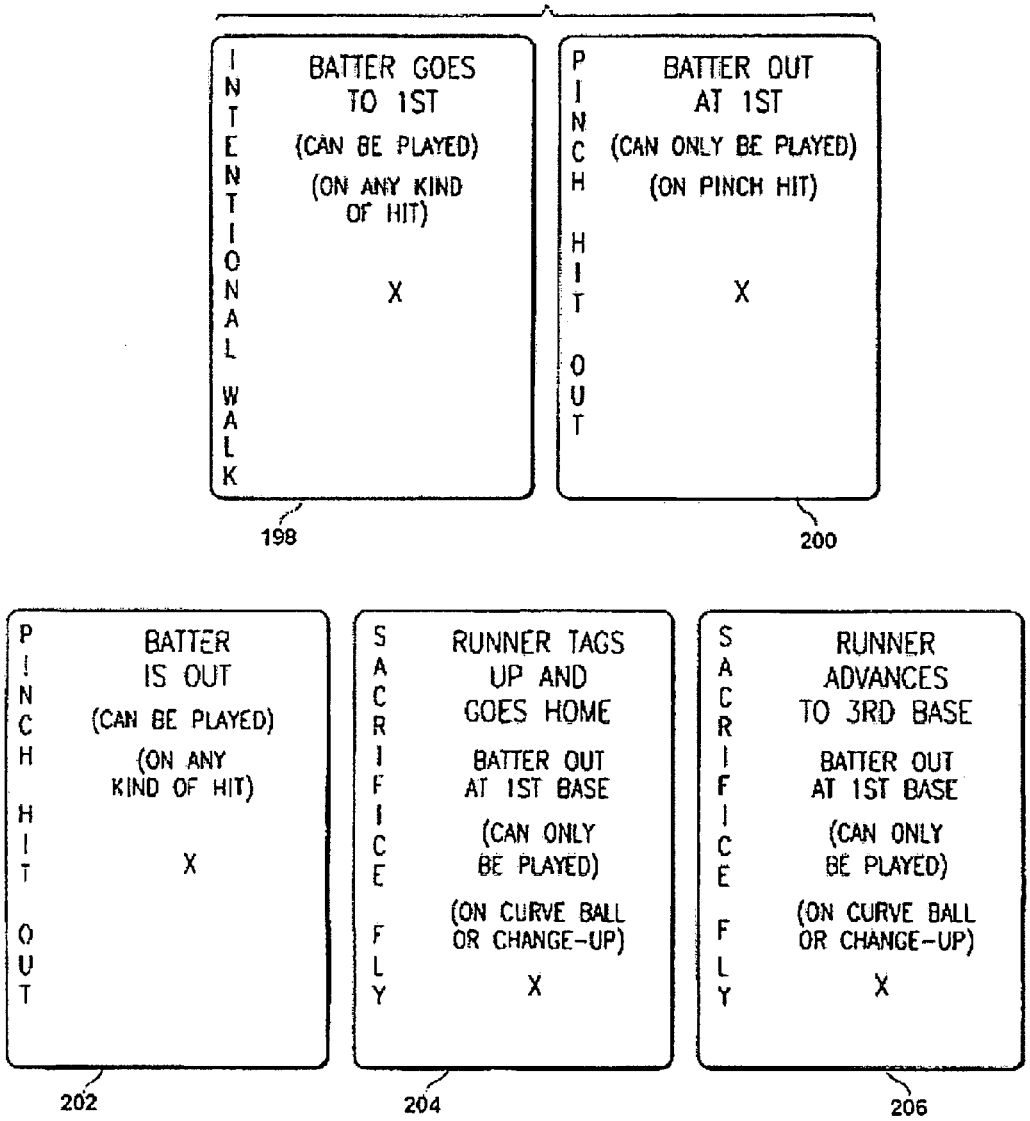

FIG. 5D depicts an intentional walk card, which is a batter goes to 1st card (198), pinch hit out cards, which include a batter out at 1st card (200) and a batter is out card (202), and sacrifice fly cards, which include a runner tags up an goes home batter out at 1st base card (204) and a runner advances to 3rd base batter out at 1st base card (206).

While these embodiments have been described with emphasis on the embodiments, it should be understood that within the scope of the appended claims, the embodiments might be practiced other than as specifically described herein.

What is claimed is:

1. An online gaming system with gambling elements for simulating a baseball game, the system comprising:

a. a server with a processor;

b. a network in communication with the server;

c. at least one client device with at least one user interface in communication with the network, wherein the at least one client device has an input device, a display device, and a monetary acceptance feature; and d. a database in communication with the processor, the database comprising:

i. an electronic deck of baseball offense cards;

ii. an electronic deck of baseball defense cards;

iii. an electronic deck of playing cards;

iv. computer instructions for instructing the processor to form a shuffled deck by electronically randomizing the electronic deck of baseball offense cards with the electronic deck of baseball defense cards;

v. computer instructions for instructing the processor to permit input of a bet from the input device and the monetary acceptance feature through the user interface and the network to the server;

vi. computer instructions for instructing the processor to electronically deal a first plurality of cards from the shuffled deck and display the first plurality of cards on the display device;

vii. computer instructions for instructing the processor to electronically deal a second plurality of cards from the shuffled deck to a second player;

viii. computer instructions for instructing the processor to designate a baseball offense player and a baseball defense player;

ix. computer instructions for instructing the processor to electronically deal a third plurality of cards from the electronic deck of playing cards to the baseball offense player and the baseball defense player;

x. computer instructions for instructing the processor to permit selection of a pitch card by the baseball defense player and display the pitch card on the display device;

xi. computer instructions for instructing the processor to permit selection of a second card by the baseball offense player responsive to the pitch card and display the second card on the display device;

xii. computer instructions for instructing the processor to electronically deal to the baseball offense player a replacement card for the second card from the shuffled deck;

xiii. computer instructions for instructing the processor to permit selection of a third card by the baseball defense player for discard or in response to the second card;

xiv. computer instructions for instructing the processor to electronically deal to the baseball defense player a replacement card for the third card from the shuffled deck;

xv. computer instructions for instructing the processor to determine a game outcome based on the pitch card, the second card, and the third card;

xvi. computer instructions for awarding winnings based on the bet and the game outcome;

xvii. computer instructions for instructing the processor to display on the display device a secondary bonus slot game if at least one play achievement occurs;

xviii. computer instructions for instructing the processor to permit input of a bonus bet from the input device and the monetary acceptance feature through the user interface and the network to the server;

xix. computer instructions for instructing the processor to electronically spin reels of the secondary bonus slot game and stop the reels; and xx. computer instructions for instructing the processor to award bonus winnings based on the bonus bet and the at least one play achievement.

2. The system of claim 1, wherein the shuffled deck comprises baseball offense cards and baseball defense cards, a. wherein the baseball offense cards comprise baseball offense hit cards and baseball offense call cards;

b. wherein the baseball offense hit cards each have a type of offensive play selected from the group consisting of: ground ball single, ground ball infield hit, ground ball drag bunt, ground ball base hit, ground ball double, long fly base hit, long fly double, long fly triple, long fly home run, line drive base hit, line drive double, line drive triple, and line drive homerun;

c. wherein the baseball offense call cards are ball cards;

d. wherein the baseball defense cards comprise baseball defense play cards and baseball defense ball cards;

e. wherein the baseball defense play cards each have a type of defensive play selected from the group consisting of: ground ball out, long fly out, and line drive out; and f. wherein the baseball defense call cards are selected from the group consisting of: foul ball call and strike.

3. The system of claim 1, wherein the electronic deck of playing cards comprises a plurality of pitch cards and a plurality of situational play cards, a. wherein each of the plurality of pitch cards has a type of pitch selected from the group consisting of: fast ball, curve ball, sinker, change-up, slider, and screw ball;

b. wherein each of the plurality of situational play cards is an offense situational play card or a defense situational play card;

c. wherein the offense situational play cards each have a type of offense situation selected from the group consisting of: steal, double steal, hit batsman, wild pitch, past ball, error, hit and run, suicide squeeze, and pinch hit;

d. wherein the defense situational play cards each have a type of defense situation selected from the group consisting of: out stealing, double steal out, double play, intentional walk, and pinch hit out;

e. wherein the baseball offense cards and the offense situational play cards have instructions advancing a simulated batter, a simulated runner, or combinations thereof, a number of simulated bases, and also have at least one instruction listing certain types of pitches which would advance the simulated batter, the simulated runner, or combinations thereof; and f. wherein the baseball defense cards and the defense situational play cards have at least one instruction indicating that the simulated batter, the simulated runner, or combinations thereof, is out, and also have at least one instruction listing certain types of offense plays or offense situations which would indicate that the simulated batter, the simulated runner, or combinations thereof, is out.

4. The system of claim 1, wherein the second card is an offense card or an offense situational card that lists the type of pitch indicated on the pitch card to advance the simulated batter, the simulated runner, or combinations thereof.

5. The system of claim 1, wherein the third card is a defense play card or a defense situational card that lists the type of offense play or offense situation indicated on the second card to indicate that the simulated batter, the simulated runner, or combinations thereof, is out.

6. The system of claim 1, wherein the database further comprises:

a. computer instructions for instructing the processor to display on the display device a simulated baseball field comprising a first base, a second base, a third base, a home plate, an area to record outs, an area to record points, and an area to record a count constituted by strikes and balls;

b. computer instructions for instructing the processor to display on the display device a simulated batter, at least one simulated runner, or combinations thereof, on the simulated baseball field; and c. computer instructions for instructing the processor to update on the display device a position of the simulated batter, a position of the at least one simulated runner, a number of outs, a number of strikes, a number of balls, a number of points, or combinations thereof, based on the game outcome.

7. The system of claim 1, wherein the monetary acceptance feature is a means for accepting credit cards, a means for accepting debit cards, a means for accepting currency, a means for accepting facility-specific credits, a card reader, a bill and coin insertion slot, a reader for cards issued by casinos, a computer keyboard, a keypad on a cellular telephone, a mouse, a touch screen, or combinations thereof.

8. The system of claim 1, wherein the second player is a simulated player controlled by the processor.

9. The system of claim 1, wherein the computer instructions for instructing the processor to permit input of the bet from the input device and the monetary acceptance feature through the user interface and the network to the server, allowing a user to insert a credit card into a credit card reader and use a keyboard or touch screen to enter and confirm a bet amount.

10. The system of claim 1, wherein the bet is a bet related to a winner of the baseball game, a bet specifying a team that will have more points at a certain point in the baseball game, a bet related to the game outcome, a bet related to an amount of points scored, a bet related to a spread in points, a bet related to points totals, or a bet related to an individual play.

11. The system of claim 1, wherein the game outcome comprises: calling a simulated batter, one or more simulated runners out, or combinations thereof, advancing a simulated batter, runners, or combinations thereof to one or more bases, calling balls or strikes, scoring points, or combinations thereof.

12. The system of claim 1, further comprising computer instructions in the database to instruct the processor to play a video, an animation, or combinations thereof that depict a representation of the game outcome.

13. The system of claim 1, wherein the at least one play achievement comprises:

a. scoring one or more points;

b. achieving one or more outs, balls, or strikes;

c. advancing a predetermined number of bases;

d. hitting a home run; or e. achieving a double play.

14. The system of claim 1, wherein the bet is stored in the database until the game outcome is determined and the winnings are awarded.

15. The system of claim 1, wherein the secondary bonus game is engaged each time a home run is hit, each time a run is scored, or each time three outs are achieved.

* * * * *